US009558906B2

(12) United States Patent
Augusta et al.

(10) Patent No.: US 9,558,906 B2
(45) Date of Patent: Jan. 31, 2017

(54) ELECTRICAL SWITCH

(71) Applicants: Zbynek Augusta, Letohrad (CZ); Filip Musil, Zachlumi (CZ)

(72) Inventors: Zbynek Augusta, Letohrad (CZ); Filip Musil, Zachlumi (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 693 days.

(21) Appl. No.: 13/706,393

(22) Filed: Dec. 6, 2012

(65) Prior Publication Data

US 2013/0187746 A1 Jul. 25, 2013

(30) Foreign Application Priority Data

Jan. 23, 2012 (DE) ..... 10 2012 200 922

(51) Int. Cl.
*H01H 89/00* (2006.01)
*H01H 71/40* (2006.01)
(Continued)

(52) U.S. Cl.
CPC ..... *H01H 89/00* (2013.01); *H01H 71/04* (2013.01); *H01H 71/40* (2013.01);
(Continued)

(58) Field of Classification Search
CPC .... H01H 71/40; H01H 71/2472; H01H 73/48; H01H 73/50; H01H 2071/042; H01H 71/04; H01H 89/00; H01H 2009/0088; H01H 2009/0094
(Continued)

(56) References Cited

U.S. PATENT DOCUMENTS 4,342,974 A * 8/1982 Nakano ..... H01H 71/1009 335/10
5,661,627 A 8/1997 Liebetruth et al.
(Continued)

FOREIGN PATENT DOCUMENTS

CN 1236178 A 11/1999
CN 1399785 A 2/2003
(Continued)

OTHER PUBLICATIONS

Godesa, EPO Machine Translation of DE 102008008032 A1.*
Office Action for Chinese Patent Application No. 201310024259.5 dated Aug. 5, 2015 with English translation.

*Primary Examiner* — Anatoly Vortman
*Assistant Examiner* — Jacob Crum
(74) *Attorney, Agent, or Firm* — Harness, Dickey & Pierce, P.L.C.

(57) ABSTRACT

An electrical switch is disclosed, especially an electrical circuit breaker, including an overcurrent tripping device which, in the event of an overcurrent situation, switches off the flow of current through the switch; and a thermal tripping device which, in the event of a thermal overload, switches off the flow of current through the switch. In at least one embodiment, the overcurrent tripping device includes a first shaft which is disposed such that, in the event of an overcurrent situation, it is rotated from a first position into a second position and thereby indicates the overcurrent situation; and the thermal tripping device includes a second shaft which is disposed such that, it is rotated in the event of a thermal overload and is also rotated as well in the event of a rotation of the first shaft and when rotated initiates a switching-off of the switch.

10 Claims, 3 Drawing Sheets

(51) Int. Cl.
*H01H 9/00* (2006.01)
*H01H 71/24* (2006.01)
*H01H 71/04* (2006.01)

(52) U.S. Cl.
CPC . *H01H 71/2472* (2013.01); *H01H 2009/0088* (2013.01); *H01H 2071/042* (2013.01)

(58) Field of Classification Search
USPC ..... 337/3, 299, 48, 50; 200/61.39
See application file for complete search history.

(56) References Cited

U.S. PATENT DOCUMENTS

| | | | | |
|---|---|---|---|---|
| 5,831,499 | A * | 11/1998 | Batteux | H01H 71/44 335/172 |
| 6,100,777 | A * | 8/2000 | Mueller et al. | 335/35 |
| 6,222,433 | B1 * | 4/2001 | Ramakrishnan et al. | 335/17 |
| 6,225,881 | B1 | 5/2001 | Felden et al. | |
| 6,788,172 | B1 | 9/2004 | Godesa et al. | |
| 7,323,956 | B1 * | 1/2008 | Puskar | H01H 71/122 335/23 |
| 2004/0251994 | A1 * | 12/2004 | Tobin et al. | 335/172 |
| 2009/0195346 | A1 * | 8/2009 | Bausch et al. | 337/13 |
| 2009/0295532 | A1 * | 12/2009 | Puhalla et al. | 337/102 |
| 2011/0073451 | A1 * | 3/2011 | Gottschalk | H01H 71/0214 200/337 |

FOREIGN PATENT DOCUMENTS

| | | | |
|---|---|---|---|
| DE | 19819242 | A1 | 11/1999 |
| DE | 102008008032 | A1 | 8/2009 |
| EP | 0721647 | A1 | 7/1996 |

* cited by examiner

ELECTRICAL SWITCH

PRIORITY STATEMENT

The present application hereby claims priority under 35 U.S.C. §119 to German patent application number DE 10 2012 200 922.1 filed Jan. 23, 2012, the entire contents of which are hereby incorporated herein by reference.

FIELD

At least one embodiment of the invention generally relates to an electrical switch.

BACKGROUND

A switch is marketed by Siemens AG, for example under the product name 3VL TMTU. This switch involves a circuit breaker switch equipped with an overcurrent tripping device. In the event of an overcurrent situation the overcurrent tripping device can switch off the flow of current through the switch. In addition the switch known from the prior art is equipped with a thermal tripping device, which switches off the flow of current through the switch in the event of a thermal overload.

SUMMARY

At least one embodiment of the invention is directed to an electrical switch which—by comparison with previous switches—reduces the dangers of the switch being operated incorrectly.

Advantageous embodiments of the inventive switch are specified in the subclaims.

Accordingly, at least one embodiment of the invention makes provision for the overcurrent tripping device to have a first shaft which is disposed such that, in the event of an overcurrent situation, it is rotated from a first position into a second position and thereby indicates the overcurrent situation, and for the thermal tripping device to have a second shaft which is disposed such that, in the event of a thermal overload, it is rotated and also, in the event of the first shaft being rotated, it is rotated along with said shaft and initiates a switching off of the switch as it rotates.

BRIEF DESCRIPTION OF THE DRAWINGS

The invention is explained below in greater detail on the basis of example embodiments, in which by way of example

For reasons of clarity the same reference characters are always used for identical or comparable components in the figures.

DETAILED DESCRIPTION OF THE EXAMPLE EMBODIMENTS

Figure 1:
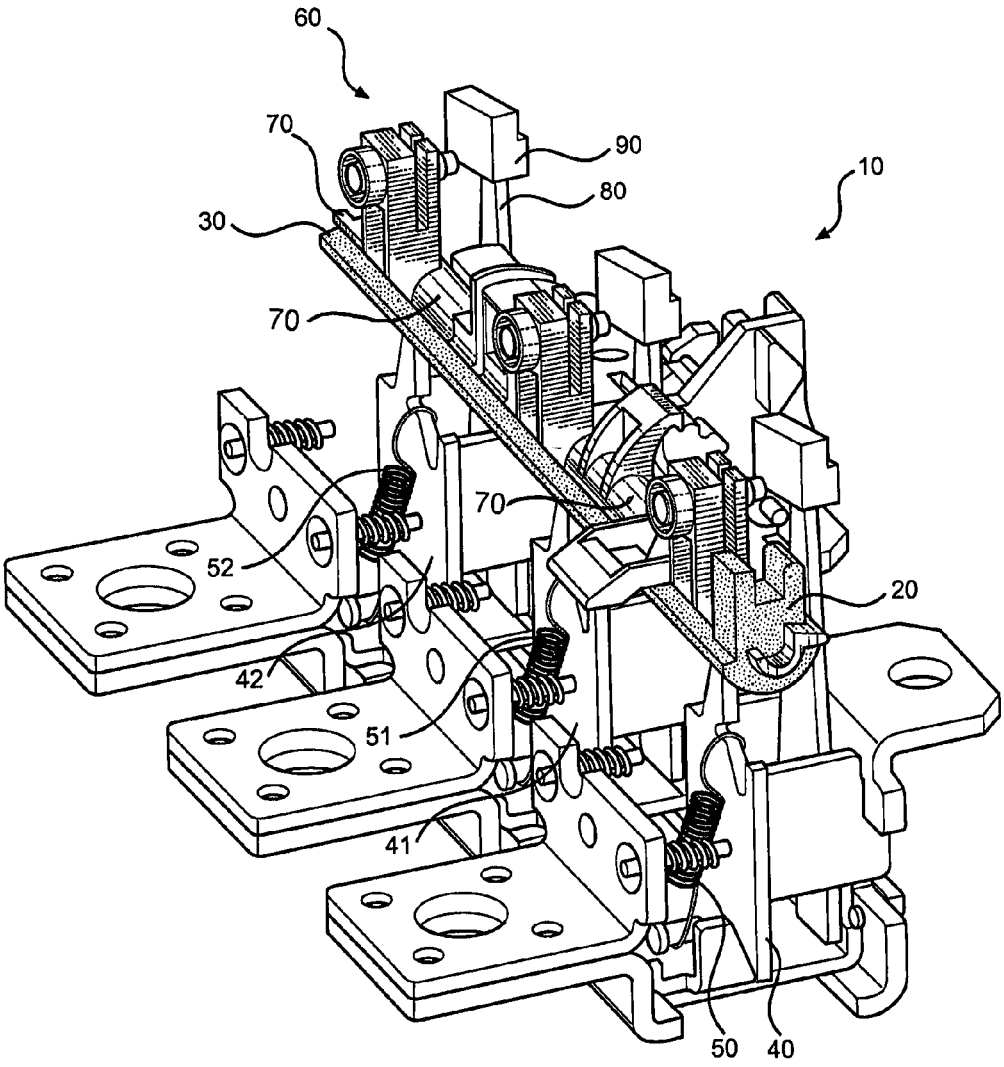
FIG. 1 shows elements of a first example embodiment for an inventive switch in a three-dimensional view obliquely from the side.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Accordingly, at least one embodiment of the invention makes provision for the overcurrent tripping device to have a first shaft which is disposed such that, in the event of an overcurrent situation, it is rotated from a first position into a second position and thereby indicates the overcurrent situation, and for the thermal tripping device to have a second shaft which is disposed such that, in the event of a thermal overload, it is rotated and also, in the event of the first shaft being rotated, it is rotated along with said shaft and initiates a switching off of the switch as it rotates.

A significant advantage of at least one embodiment of the inventive electrical switch lies in the fact that it can be seen on the basis of the position of the first shaft and of the second shaft whether the tripping was solely caused by the thermal tripping device or has been caused by the action of the overcurrent tripping device as well. If namely both the first shaft and also the second shaft are rotated in relation to a predetermined basic position—for a switched-on switch—, the tripping is to be attributed to the overcurrent tripping device, because the first shaft, in the event of the device tripping, also rotates the second shaft. Since it can thus be seen on the basis of the position of the first and second shaft whether or not the overcurrent tripping device has tripped, an inadvertent or unwanted switching back on of the switch in the event of a short-circuit can be avoided.

In view of a compact and low-cost layout of the switch it is seen as advantageous for the first shaft and the second shaft to be disposed coaxially and to be supported by individually assigned or separate bearings. The bearings of the first shaft are preferably separate from the bearings of the second shaft.

Especially preferably the second shaft is disposed within the first shaft.

In order to be able to distinguish particularly securely between thermal tripping and tripping as a result of an overcurrent it is seen as advantageous for the second shaft to be embodied such that it is rotated in the event of a thermal overload without rotating the first shaft or causing said shaft to rotate along with it.

In respect of the layout of the thermal tripping device, it is viewed as advantageous for this to have a bimetal element which deforms when heated up and initiates or causes a rotation of the second shaft.

In order to avoid an undesired automatic resetting of the overcurrent tripping device, it is seen as advantageous if the first shaft—in the event of an overcurrent situation and after a rotation—is held in the second position.

The same applies to the thermal tripping device: in relation to this device it is seen as advantageous for the overcurrent tripping device, especially its first shaft, to hold the second shaft in the position which the second shaft has reached by rotating along with the first shaft.

The electrical switch can for example involve a multiphase electrical switch. In the case of a multiphase electrical switch it is seen as advantageous if the first switch has a phase-individual switching lug for each electrical phase to be switched. For each electrical phase to be switched the overcurrent tripping device preferably has a tripping element in each case which interacts with the respectively assigned phase-individual switching lug on the first shaft and, in the event of an overcurrent situation, pivots the switching lug or enables the switching lug to pivot.

In order to make tripping of the switch caused by an overcurrent especially easy to recognize, it is seen as advantageous for a lever to be disposed on the first shaft which, when the first shaft rotates from the first position into the second position, is pivoted into a "tripped" position, in which it indicates the overcurrent situation that has occurred, i.e. a short-circuit for example.

In order to prevent the switch being inadvertently switched back on in the event of an overcurrent situation or a short-circuit, it is seen as advantageous for the lever, in its "tripped" position, to hold the first shaft in the second position and the second shaft in that position that the second shaft has reached by being rotated along with the first shaft.

FIG. 1 shows components of a three-phase electrical switch 10. An overcurrent tripping device 20, which has a first shaft 30 as well as for each electrical phase to be switched by the three-phase switch 10, has a phase-individual tripping element, is shown. The phase-individual tripping elements are indicated in FIG. 1 by the reference characters 40, 41 and 42.

The tripping elements 40, 41 and 42 each have the spring force of a phase-individual spring applied to them; the springs are identified in FIG. 1 with the reference characters 50, 51 and 52.

If one or more phase currents which flows through the three-phase switch 10 exceed a predetermined threshold value, the tripping elements 40, 41 and 42 affected in each case by the overcurrent situation are pivoted in each case against the spring force of the assigned springs 50, 51 and 52, which rotates the first shaft 30 and trips the overcurrent tripping device 20.

In the example embodiment in accordance with FIG. 1 the tripping elements 40, 41 and 42 are each formed by a hinged armature which, in the event of an overcurrent situation, is pivoted out and during the pivoting rotates the first shaft 30.

The three-phase switch 10 in accordance with FIG. 1 is additionally equipped with a thermal tripping device 60 which comprises a second shaft 70 as well as a bimetal element 80 in each case for each electrical phase of the switch 10 to be switched and also an attachment piece 90 connected to the respective bimetal element 80. In the event of a thermal overload of one or more phases of the electrical switch the bimetal elements 80 involved act on the second shaft 70 and pivot the latter, which causes the electrical switch 10 to be switched off.

In the example embodiment in accordance with FIG. 1, the second shaft 70 of the thermal tripping device 60 is supported coaxially to the first shaft 30 of the thermal tripping device 20. The arrangement of the two shafts 30 and 70 in this case is selected such that the second shaft 70 is located within the first shaft 30. The two shafts 30 and 70 are supported independently of one another so that said shafts can at least also be rotated independently of one another or relative to one another.

The first shaft 30 and the second shaft 70 preferably work together as follows:

1. Overcurrent Situation:

In the event of an overcurrent situation the tripping element 40, 41 or 42 of the electrical phase affected by the overcurrent is pivoted, which results in the first shaft 30 being rotated. The first shaft 30 and the second shaft 70 in this case are coupled to one another such that, in the event of the first shaft 30 being rotated the second shaft 70 is also rotated. The rotation of the second shaft 70 or the rotation of the second shaft 70 along with the first shaft subsequently leads to a tripping or switching off of the electrical switch 10.

2. Thermal Overload:

In the event of a thermal overload or overheating of one or more bimetal elements 80 of the thermal tripping device 60, the result is a bending of the bimetal element 80 involved and, associated therewith, a rotation of the second shaft 70 through which—preferably without involvement of the first shaft 30 and without said shaft rotating as well—this results in a tripping or switching off of the three-phase switch 10.

As can be taken from the remarks above, after tripping of the switch 10 it can be established on the basis of the switch position of the first shaft 30 and of the second shaft 70 whether the electrical switch 10 has been switched off because of an overcurrent situation or because of a thermal overload. If namely after a switch-off the first shaft 30 has rotated in relation to its basic position in the switched-on state, the tripping of the electrical switch must be attributable to an overcurrent situation; this is because a rotation of the first shaft 30 only takes place if one or more of the tripping elements 40, 41 or 42 have caused the first shaft 30 to rotate. If on the other hand the position of the first shaft 30 is unchanged or if the first shaft 30 is in its basic position as in the switched-on state, the tripping of the switch 10 must be attributable to a thermal overload; this is because, in the event of a thermal overload, only the second shaft 70 of the thermal tripping device 60 is rotated and the switch 10 tripped thereby, whereas the position of the first shaft 30 remains unchanged.

The associated rotation of the second shaft 70 by the first shaft 30 can be effected for example by one or more stop elements which strike one another during a relative rotation of the two shafts and rotate the second shaft 70 as well.

Especially preferably the switch 10 has a mechanism, not shown in any greater detail in FIG. 1, which makes it possible to switch the switch 10 back on again once it has tripped only after the first shaft 30 has been reset into its original position or its basic setting.

Figure 2:
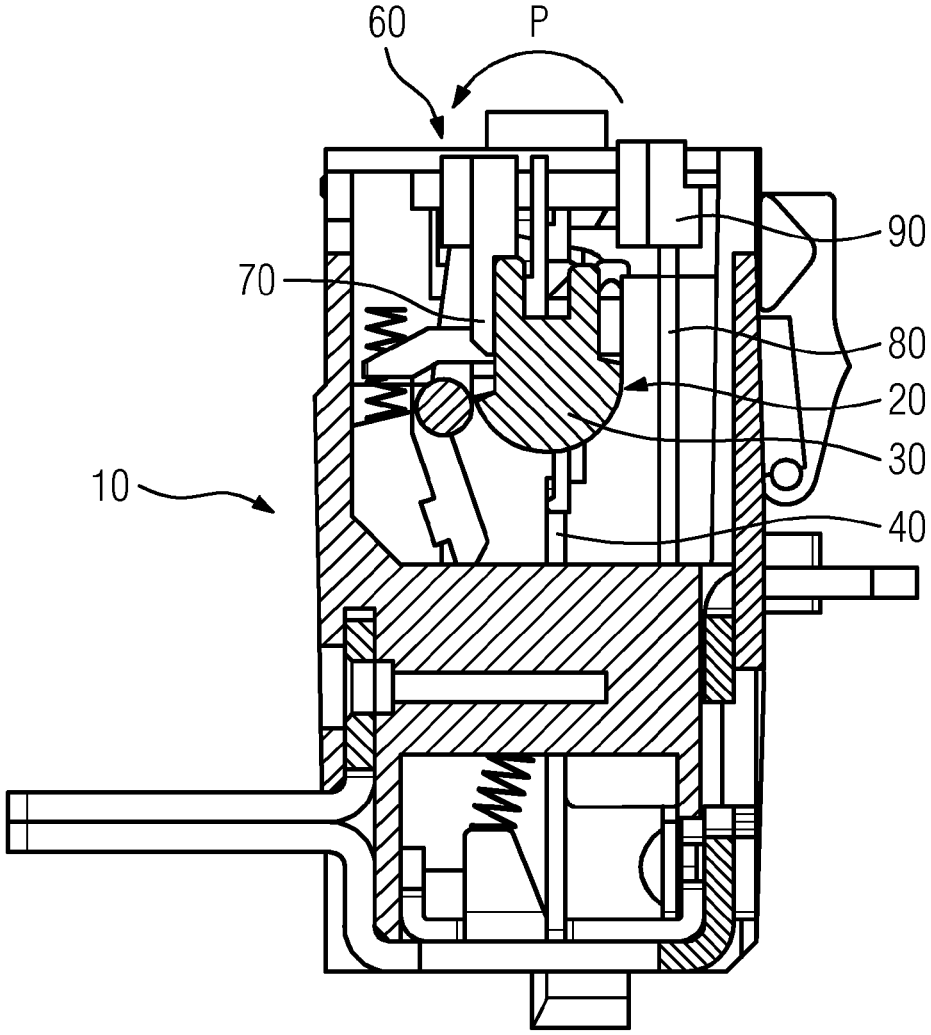
FIG. 2 shows the parts in accordance with FIG. 1 in cross-section and FIG. 3 shows elements of a second example embodiment for an inventive switch in a three-dimensional view from the side.

FIG. 2 shows the switch 10 according to FIG. 1 in cross section. The second shaft 70, one of the bimetal elements 80 and also one of the attachment pieces 90 of the thermal tripping device 60 can be seen in the figure.

The first shaft 30 as well as one of the tripping elements 40 of the overcurrent tripping device 20 can be seen.

In addition the direction of rotation of the first shaft 30 and of the second shaft 70 in the event of tripping caused by an overcurrent and/or a thermal tripping is indicated in FIG. 2 by way of an arrow P.

Figure 3:
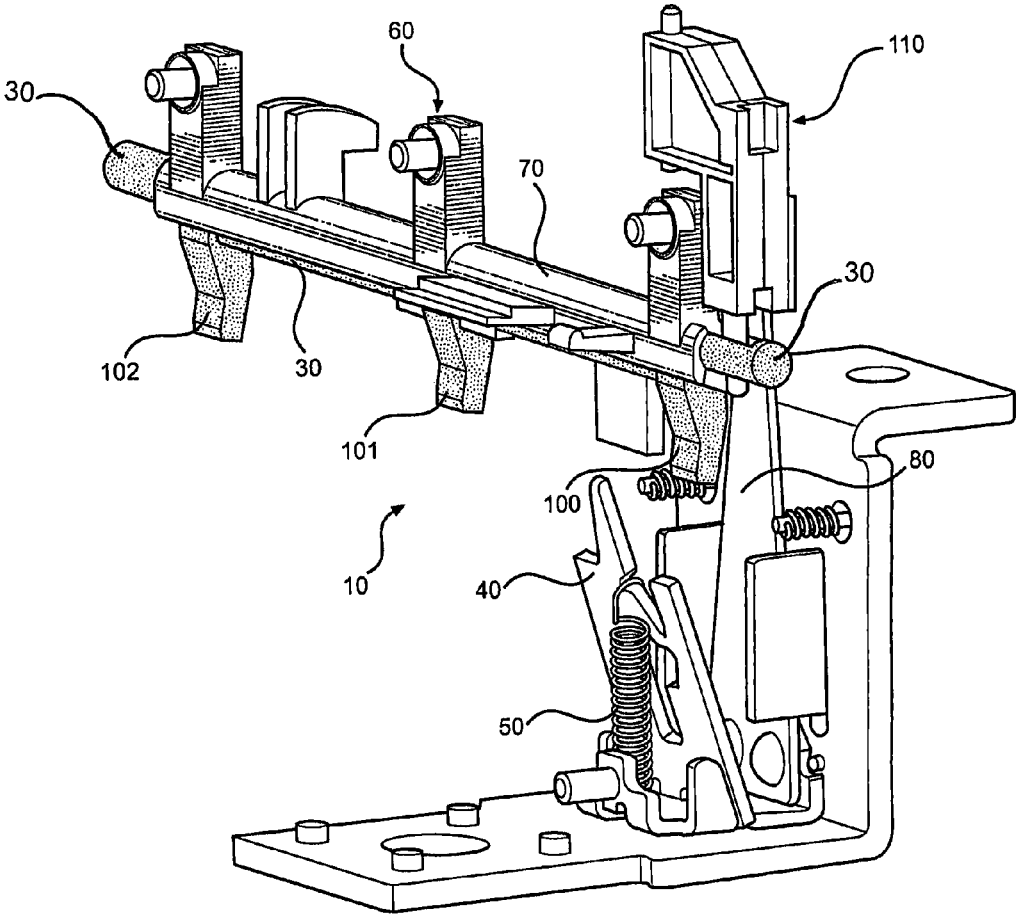

FIG. 3 shows a second exemplary embodiment for an inventive three-phase switch 10. It can be seen that a switching lug is provided on the first shaft 30 of the overcurrent tripping device 20 for each electrical phase to be switched; the switching lugs are identified by the reference characters 100, 101 and 102. The switching lug 100 acts together with the tripping element 40 and is pivoted by the latter when the tripping element 40 is pivoted against the spring force of the spring 50 in the direction of the switching lug 100.

An indicator lever 110, which shows the position of the first shaft 30, is connected to the first shaft 30 of the overcurrent tripping device 20.

The second shaft 70 of the thermal tripping device 60 can also be seen in FIG. 3.

The further shaft 30 and also the second shaft 70 are also disposed coaxially to one another in the example embodiment depicted in FIG. 3 and are held by individually-assigned bearings which are not shown in detail in FIG. 3 for reasons of clarity.

If, with the switch 10 in accordance with FIG. 3, an overcurrent situation occurs, then for example the tripping element 40 is pushed against the spring force of the spring 50 onto the switching lug 100, so that the first shaft 30 of the overcurrent tripping device 20 is rotated. A rotation of the first shaft 30 causes the second shaft 70 to rotate as well, which in its turn initiates the switching-off of the electrical switch 10.

After the switch 10 trips it can be seen from the position of the indicator lever 110 whether the switch has tripped as a result of a thermal overload or as result of an overcurrent: if the indicator lever 110 namely assumes the position shown in FIG. 3, the switching-off of the switch 10 has occurred as a result of a thermal tripping of the thermal tripping device 60 or by only the shaft 70 rotating. If on the other hand the indicator lever 110 is pivoted relative to the position shown in FIG. 3, because one of the tripping elements, for example the tripping element 40 in accordance with FIG. 3, has pivoted the switching lug 100 and thereby the first shaft 30, the tripping of the switch will be attributable to an overcurrent situation, for example a short-circuit.

Preferably it is only possible to switch the switch 10 back on again in accordance with FIG. 3 if the first shaft 30 and the indicator lever 110 have been rotated into the basic position predetermined or shown in FIG. 3.

Although the invention has been illustrated and described in greater detail by preferred exemplary embodiments, the invention is not restricted by the disclosed examples and other variations can be derived therefrom by the person skilled in the art without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Switch
20 Overcurrent tripping device
30 Shaft
40 Tripping element
41 Tripping element
42 Tripping element
50 Spring
51 Spring
52 Spring
60 Thermal tripping device
70 Shaft
80 Bimetal element
90 Attachment piece
100 Switching lug
101 Switching lug
102 Switching lug
110 Indicator lever
P Arrow

What is claimed is:

1. An electrical switch, comprising:

the overcurrent tripping device including a first shaft that, in the event of the overcurrent situation, rotates from a first position into a second position and, through the rotation, indicates the overcurrent situation; and a thermal tripping device that, in the event of a thermal overload, switches off the flow of current through the switch, the thermal tripping device including a second shaft that rotates, in the event of a thermal overload, and rotates in the event of a rotation of the first shaft and initiates the switching off of the switch when the second shaft rotates, wherein the second shaft is nested within the first shaft such that the first shaft forms a sleeve around the second shaft.

2. The switch of claim 1, wherein the second shaft is rotatable in the event of a thermal overload, without rotating of the first shaft.

3. The switch of claim 1, wherein the thermal tripping device includes a bimetal element, that deforms when heated, and initiates or causes a rotation of the second shaft.

4. The switch of claim 1, wherein the overcurrent tripping device is embodied such that the first shaft, after rotation into the second position, is retained in this second position.

5. The switch as claimed in claim 4, wherein the overcurrent tripping device, in the event of an overcurrent situation, maintains the second shaft in the position which the second shaft has reached by being rotated along with the first shaft.

6. The switch of claim 1, wherein the first shaft includes a phase-individual switching lug for each electrical phase to be switched, and wherein the overcurrent tripping device is equipped with a tripping element for each electrical phase to be switched, each being interactable with each respectively assigned phase-individual switching lug on the first shaft and, in the event of an overcurrent situation, pivoting each respective switching lug or enabling each respective switching lug to be pivoted.

7. The switch of claim 1, wherein the first shaft includes a lever pivotable into a "tripped" position during a rotation of the first shaft from the first position into the second position, in which it indicates the overcurrent situation.

8. The switch of claim 7, wherein in the "tripped" position, the lever retains the first shaft in the second position and the second shaft in a position that the second shaft has reached by being rotated along with the first shaft.

9. The switch of claim 1, wherein the switch is an electrical circuit breaker.

10. The switch of claim 1, wherein the first shaft is rotatable around the second shaft.

* * * * *